US005797505A

United States Patent [19]

Kaura

[11] Patent Number: 5,797,505

[45] Date of Patent: Aug. 25, 1998

[54] DEBRIS IMMUNE ANIMAL FEEDING NIPPLE

[76] Inventor: Kam Kaura, 30 Coronado Pointe, Laguna Niguel, Calif. 92677

[21] Appl. No.: 655,968

[22] Filed: May 31, 1996

[51] Int. Cl.[6] ..... A61J 11/02; A61J 11/04

[52] U.S. Cl. ..... 215/11.5; 215/11.1

[58] Field of Search ..... 215/11.1, 11.5

[56] References Cited

U.S. PATENT DOCUMENTS

| | | | |
|---|---|---|---|
| 1,902,433 | 3/1933 | Brown | 215/11.1 |
| 2,223,179 | 11/1940 | Lougheed | 215/11.1 |
| 2,513,896 | 7/1950 | Searer | 215/11.5 |
| 2,688,326 | 9/1954 | Lerman | 215/11.5 X |
| 4,993,568 | 2/1991 | Morifuji et al. | 215/11.1 |
| 5,474,028 | 12/1995 | Larson et al. | 119/71 |

FOREIGN PATENT DOCUMENTS

| | | | |
|---|---|---|---|
| 1058610 | 3/1954 | France | 215/11.5 |
| 584279 | 4/1993 | Japan | 215/11.1 |
| 2250017 | 5/1992 | United Kingdom | 215/11.5 |

*Primary Examiner*—Sue A. Weaver

*Attorney, Agent, or Firm*—Gene Scott—Patent Law & Venture Group

[57] ABSTRACT

An animal nursing nipple provides a milking slit configuration providing for fluid flow with less effort by the animal without a reduction in nipple life. A vent valve provides for self cleaning action as the animal nurses. An annular skirt around the base of the nipple lies in contact with the feed bottle preventing debris from contaminating the seal of the nipple on the bottle. An improved interior space accepts a range of bottle sizes and shapes.

4 Claims, 2 Drawing Sheets

DEBRIS IMMUNE ANIMAL FEEDING NIPPLE

BACKGROUND OF THE INVENTION

1. Field of the Invention

This invention relates to a nipple for feeding liquids, such as milk, to animals, particularly young mammals such as calves, piglets, lambs, foals, puppies, kittens, or the like.

2. Description of Related Art

Invention and use of devices in the field of the invention is known to the public, as they are used for the intended purposes as defined herein. The following art defines the state of this field at this time:

A conventional animal feeding nipple for feeding liquids, such as milk or milk replacer, to domesticated mammals is formed out of a flexible, elastomeric or resilient material, such as natural or synthetic rubber or flexible plastic. The conventional nipple will comprise a nipple tube, on which the mammal will suckle to withdraw liquid, connected to a means for attaching the nipple tube to a liquid-feed receptacle or container. See, for example, U.S. Pat. Nos. 2,628,591, 2,699,778, and 3,042,002.

The conventional nipple may be attached, via the attachment means, to a liquid-feed receptacle or container, such as a closed plastic or glass bottle, carboy, barrel, pail, or the like, in which the liquid feed is sealed from atmospheric pressure and from which the liquid feed can flow into the inside of the nipple tube. Typically the nipple will be attached to the closed liquid-feed receptacle or container at a position such that the liquid feed will flow under the influence of gravity into the inside of the nipple tube.

The conventional nipple comprises proximate the distal end, i.e., the end furthest from the receptacle, a self-sealing orifice or aperture. In response to sucking by a mammal on the nipple tube during suckling, this aperture opens and allows liquid to flow into the mammal's mouth. Then, when the mammal, during the suckling cycle, discontinues sucking on the nipple tube, the aperture spontaneously seals and stops the flow of liquid.

Conventionally, before a mammal begins to remove liquid feed from a closed receptacle through a nipple, where the inside of the receptacle and nipple is substantially sealed from atmospheric pressure, the liquid inside the receptacle and nipple will be at or close to atmospheric pressure. When liquid is removed from the closed receptacle through the nipple, by sucking by the mammal on the nipple tube, the pressure inside the nipple and the receptacle is reduced and, consequently, a pressure differential is created between the inside and outside of the receptacle and nipple. The pressure outside will typically be the local atmospheric pressure.

This pressure differential is a problem that impairs the efficiency of feeding liquids to domesticated mammals, especially milk or milk replacers to young mammals. The pressure differential causes low flow of liquid feed to the animal and may cause collapse or breakage of the liquid-feed receptacle.

Prior art nipples have a vent through the wall of the nipple, aft a position which is not blocked from exposure to the atmosphere when the mammal is suckling on the nipple tube. The vent is present to overcome the problem of the pressure differential that is created during sucking of liquid out of the receptacle through the nipple. This vent may be located for example on a transverse portion of the nipple that joins the proximal end of the nipple tube, i.e., the end closest to the receptacle when the nipple is attached to a liquid-feed receptacle. During and after suckling, air is drawn into the nipple and feed receptacle through this vent to reduce and eventually eliminate this pressure differential. The vent in prior art nipples is simply a hole that penetrates the wall of the nipple. The hole has the shape of a cylinder or truncated cone, with the narrower cross-section of the cone at the inside surface of the nipple.

The vents in prior art nipples do not restrict flow of air or liquid to one direction, i.e., from outside to inside the nipple. A prior art vent with a cross-sectional area at the inside wall of the nipple that is large enough to be useful in relieving the pressure differential developed during suckling invariably allows leakage of liquid feed. Consequently, animal feeding nipples of the prior art that are effective in solving the problem of the pressure differential, discussed above, disadvantageously allow leakage of liquid feed out from the nipple-receptacle combination.

Larson, U.S. Pat. No. 5,474,028 teaches a vent design that overcomes the leakage problem by shaping the vent flaps in the opposite sense as those of the nipple feed vent. In this way the Larson nipple provides two, one-way valves, one for an outflow of feed, and the other for an inflow of air to make up for the lost volume of feed and prevent nipple collapse. The Larson nipple prevents leakage since the vent tends to seal tighter as interior pressure increases. However, should a bit of debris lodge within the flaps of the vent, it will remain open and tend to leak. Since interior pressure tends to force the vent flaps tighter around the debris, leakage will continue until the debris is manually removed.

Additionally, the prior art nipples including the Larson nipple have no means for preventing debris from forming at, or near the seal of the nipple around the bottle neck. This can be a problem as debris tends to weaken this seal, again causing leakage. The prior art nipples all teach the placement of the vent in a well within the sidewall in order to help shelter it from debris. However, the axis of the prior art wells is generally placed parallel with the longitudinal axis of the nipple itself. This places the well in a position that is ideal for receiving debris from the milking animal. Another problem with the prior art nipples is their inability to correctly and tightly seal over a range of bottle sizes and shapes. These and other problems with the prior art nipples are overcome in the present invention.

SUMMARY OF THE INVENTION

The present invention teaches certain benefits in construction and use which give rise to the advantages described below. The invention is a milking nipple primarily designed for young farm animals such as calves and the like. When compared with prior art devices, the present inventive nipple provides an improved milk flow valve slit configuration providing the advantage of easier flow without sacrificing strength and durability in use, an improved vent valve configuration and orientation providing the advantages of excluding, and automatically expelling particulate which might otherwise clog the valve, the addition of a nipple skirt providing the advantage of excluding dirt and debris from the point of sealing of the nipple with the bottle to which it mounts, an improved base rim for easier mounting of the nipple on a bottle, and an improved interior shape capable of accepting a wide range of bottle shapes and sizes.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a nipple for feeding an animal such as a calf. In such drawings.

DETAILED DESCRIPTION OF THE PREFERRED EMBODIMENT

Figure 1:
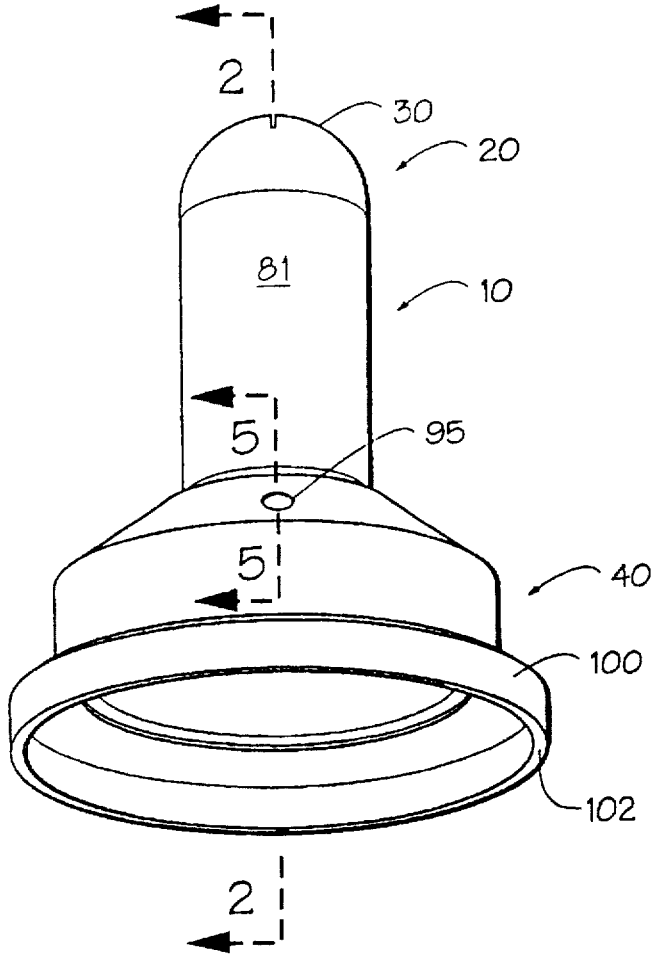
FIG. 1 is a perspective view of the preferred embodiment of the present invention.
Figure 3:
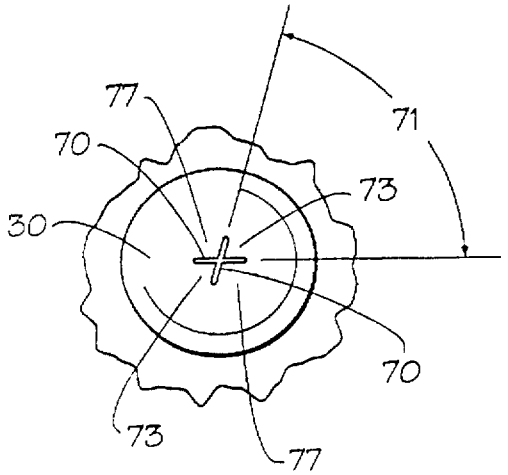
FIG. 3 is a partial plan view thereof as seen from line 3—3 in FIG. 2 particularly showing the first slits in the nipple.

The above described drawing figures illustrate a molded nipple 10 configured for animal feeding, the nipple 10 comprises a tube of an elastic material preferably a rubber, and more particularly a natural rubber. The nipple 10, as shown in FIG. 1, is closed at one end 20 by a dome shaped terminus 30. The other end 40 of the nipple 10 forms an open nipple annular rim 50 suitable for fitting tightly over the neck of a animal feed bottle 60 such as for feeding milk to a calf. The dome shaped terminus 30 provides a pair of first linear, through slits 70, the slits mutually intersect at an angle 71 of less than 90 degrees. The slits 70 create four flaps, two smaller flaps 73 and two larger flaps 77 which, under suckling action, tend to mutually part, allowing milk or another fluid to move out of the nipple. The use of angle 71 provides for less rigidity in the larger flaps 77 as compared with the smaller flaps 73. This means that the fluid may flow out of the nipple 10 with greater ease, i.e., less sucking pressure, then with the conventional 90 degree slit relationship, given the same material and material thickness. We have discovered that an angle 71 of 75 degrees seems to provide optimum performance in calf milking in a natural rubber nipple having a dome of ½ inch outside radius, a slit length of ¼ inch, and a wall thickness of ⅛ inch. The use of an included angle of less then 90 degrees between slits 70 is a discovery that opens up a new degree of freedom in the design and material selection for milking nipples. It has been found that because the milk flows more easily, the nipple does not receive as much punishment from the calf, etc., so that nipples last 2 to 3 weeks longer then standard nipples of the same general configuration and wall thickness, etc.

Figure 4:
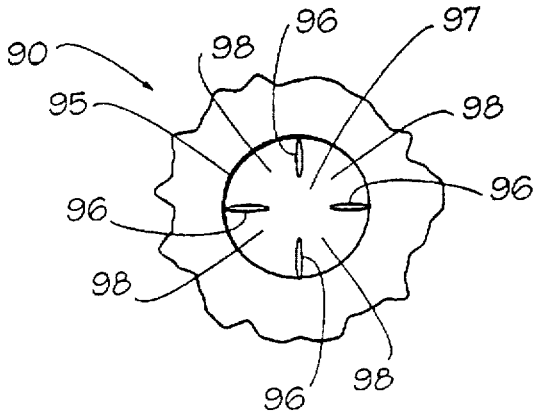
FIG. 4 is a partial plan view thereof as seen from line 4—4 in FIG. 2 particularly showing the flexible membrane in the nipple.
Figure 5A:
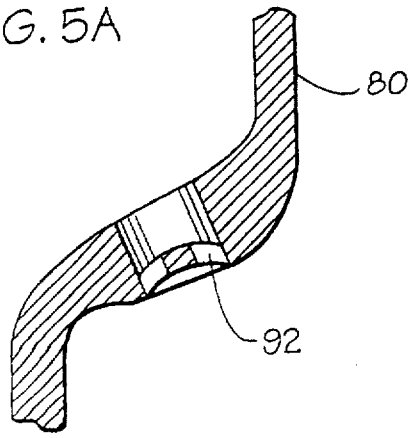
FIGS. 5A and 5B are cross-sectional views thereof taken in elevation along line 5—5 in FIG. 4 and showing the manner in which the flexible membrane moves with pressure differentials established across it.
Figure 5B:
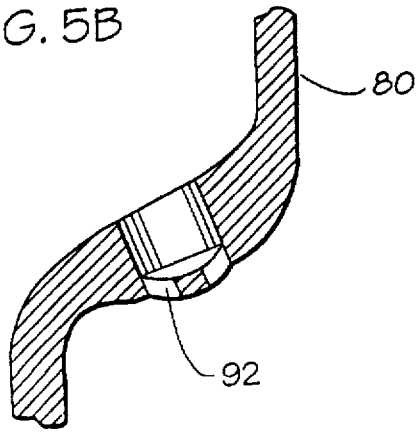

A sidewall 80 (FIG. 2) of the tube 10 provides a vent 90 comprising a planar disk shaped flexible membrane 92 having an axis of motion 94 oriented normal to the membrane 92. The membrane 92 has a plurality of equally spaced, radially oriented, non-intersecting, second linear, through slits 96, as best seen in FIG. 4, defining a central membrane portion 97 and relative thereto, a plurality of circumferentially adjacent interconnect membrane portions 98, so that with a pressure differential across the membrane 92, the flexible membrane stretches into a concave shape as shown in FIGS. 5A and 5B, causing the second slits 96 to form open apertures, as shown in FIG. 4, for equalizing the pressure differential. This membrane 92 is self cleaning since it works from concave up to concave down on each alternate cycle of sucking and pressing by the animal, and it fully stabilizes the interior pressure within the feed bottle 60 and nipple 10.

The invention further may include an annular flexible skirt 100 extending from the sidewall and terminating in a skirt annular rim 102. The skirt 100 is generally positioned and shaped so that the skirt annular rim 102 contacts the exterior surface 62 of the bottle 60 when the nipple is mounted on it. This prevents debris incursion under the nipple annular rim 50. The skirt 100 also provides for improved gripping of the nipple 10.

The nipple sidewall 80 has an interior surface 82 and an exterior surface 81, and the flexible membrane 90 is positioned adjacent to the interior surface 82 in a circular well 95 in the sidewall 80. The axis of motion 94 of the flexible membrane 90 is coaxial with a central axis of the circular well 95 and forms an acute angle 91 with a longitudinal axis 12 of the nipple 10. This angle 91 has been discovered to be critical in assuring that debris captured within the circular well 95 is able to fall out of the well 95 when the nipple is placed in its usual inverted orientation when nursing animals. It has been discovered that an angle 91 equal to approximately 20 degrees fulfills this function uniquely in that it places the well 95 out of line-of-sight of debris originating from the nipple terminus 30, while still allowing any debris within the well 95 to fall downwardly due to gravity, thereby not soiling the membrane 92.

Figure 2:
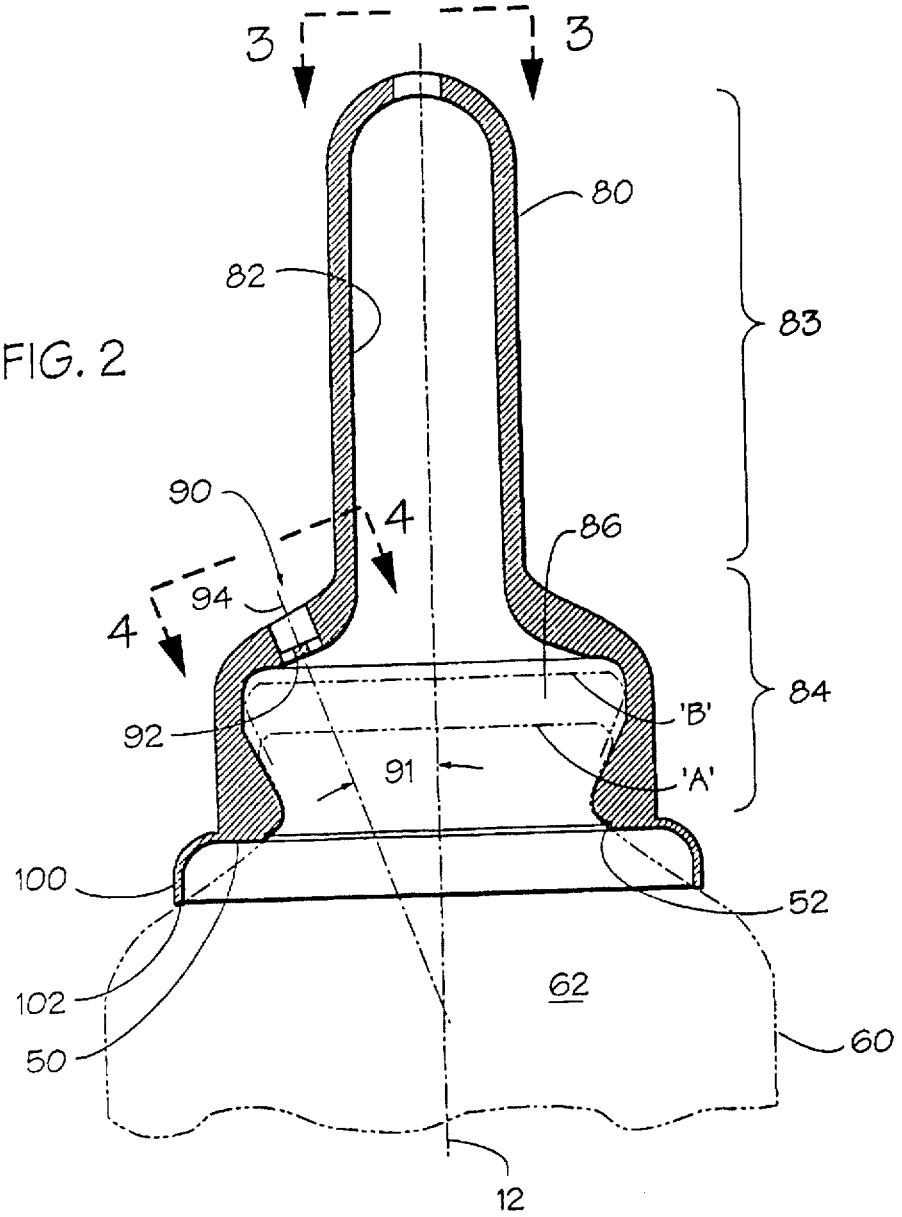
FIG. 2 is a cross-sectional view thereof taken in elevation along line 2—2 in FIG. 1.

The sidewall 80 includes a first portion 83 extending from the dome shaped terminus 30, and a second portion 84 formed as a continuation of the first portion; see FIG. 2. The sidewall 80 in the first portion 83 is tapered, so that it is thickest at the dome shaped terminus 30 and diminishes in thickness as one moves away from the dome shaped terminus 30 toward the second portion 84. The taper is slight. Typically, the wall is 120 mils thick near the dome shaped terminus 30, and 100 mils thick at its juncture with the second portion 84. It has been discovered that the thinner wall thickness improves the ability of the animal to compress the nipple 10 more easily, while the thicker wall thickness provides added toughness in contact with the teeth of the animal which contact the nipple 10 near the terminus 30. Additionally, the thinner portion of the nipple 10 is able to flex more easily in cold weather. Finally, the tapered shape, when executed in the interior of the nipple 10 allows the nipple 10 to more easily release from the molding anvil.

The second portion 84 of the sidewall terminates at the nipple annular rim 50, the interior surface 82 of the second portion 84 of the sidewall 80 diverges from the annular rim 50 to join a right circular portion 86 of the interior surface 82, so as to seal around a range of bottle neck sizes and shapes engaged within the second portion 84 of the sidewall. In FIG. 2, bottle 62 is shown to have two alternative upper lips; "A" or "B". The right circular portion 86 of the nipple 10 is of a size as to accommodate a range of bottles neck sizes.

The nipple annular rim 50 includes an annular relief 52 sized and positioned for adapting the nipple 10 to more easily stretch for mounting the nipple 10 on the neck of the bottle 60. This improvement allows a substantial increase in the mass of the sealing portion of the nipple without adding significantly to the hand strength required in mounting the nipple 10. Relief 52, too, acts as a tactile guide for centering the nipple 10 on bottle 60 during the process of installation.

In use, the nipple annular rim 50 of nipple 10 is stretched over the neck of the bottle 60 which has been filled with a animal feed such as milk, thereby mounting the nipple 10 on the bottle 60. The bottle 60 with the nipple 10 are then substantially inverted to place the distal end of the nipple 10 into the animal's mouth. While suckling on the nipple 10, the nipple first portion 83 is pressed and compressed by the lips and teeth of the nursing animal. This tends to cause a momentary over-pressure within the nipple 10. This causes the membrane 92 to bow outwardly as shown in FIG. 5A. When, a moment later, milk is drawn out of the nipple 10 through slits 70, a momentary under-pressure within the nipple is produced causing the membrane 92 to bow inwardly as shown in FIG. 5B. In practice, the bowing out of the nipple is slight and does not allow any of the milk to escape from the vent 90. Bowing inwardly may be slight or extensive and can cause the slits 96 to open forming apertures, as shown in FIG. 4, for admittance of air into the nipple. The cyclic inward and outward bowing of the membrane 92, as the animal sucks provides for automatic expulsion of any debris that might be lodged in any of the slits 96.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A nipple configured for animal feeding when mounted upon an animal feeding bottle, the nipple comprising:

(A) a tube of an elastic material, closed at one end by a dome shaped terminus, the other end forming an open nipple annular rim suitable for fitting tightly over the neck of the animal feeding bottle;

(B) the dome shaped terminus providing a pair of first linear, through slits, the slits mutually intersecting at an angle of less than 90 degrees;

(C) a sidewall of the tube providing a vent comprising a planar disk shaped flexible membrane having an axis of motion oriented normal to the membrane, the membrane having a plurality of equally spaced, non-intersecting, radially oriented, second linear, through slits, defining a central membrane portion and relative thereto, a plurality of circumferentially adjacent interconnect membrane portions, so that with a pressure differential across the membrane, the flexible membrane stretches into a concave shape, the second slits thereby being widened for relieving pressure from within the feeding bottle;

(D) an annular flexible skirt extending from the sidewall and terminating in a skirt annular rim, the skirt generally positioned and shaped so that the skirt annular rim contacts the exterior surface of a bottle when the nipple is mounted thereon so as to prevent debris from moving into contact with the nipple annular rim; and wherein the sidewall has an interior surface and an exterior surface, the flexible membrane being positioned adjacent the interior surface in a circular well within the sidewall, and wherein the axis of motion of the flexible membrane is coaxial with a central axis of the circular well and forms an angle of approximately 20 degrees with a longitudinal axis of the nipple.

2. The nipple of claim 1 wherein the sidewall includes a first portion extending from the dome shaped terminus, and a second portion integrally formed as a continuation of the first portion, the sidewall in the first portion being tapered, said sidewall being thickest at the dome shaped terminus and diminishing therefrom.

3. The nipple of claim 2 wherein the second portion of the sidewall diverges from the annular rim, a diverging interior surface joining a right circular portion of the interior surface, and therefrom a convergent portion of the interior surface, so as to seal around a range of bottle neck sizes within the second portion of the sidewall.

4. The nipple of claim 1 wherein the nipple annular rim includes an annular relief sized and positioned for adapting the nipple to more easily stretch for mounting the nipple on the neck of the bottle.

* * * * *